United States Patent [19]

Nobs

[11] Patent Number: 4,559,480

[45] Date of Patent: Dec. 17, 1985

[54] COLOR MATRIX DISPLAY WITH DISCHARGE TUBE LIGHT EMITTING ELEMENTS

[75] Inventor: Erwin Nobs, Evilard, Switzerland

[73] Assignee: Omega SA, Bienne, Switzerland

[21] Appl. No.: 551,800

[22] Filed: Nov. 15, 1983

[30] Foreign Application Priority Data

Nov. 15, 1982 [FR] France ..... 82 20334

[51] Int. Cl.[4] ..... H05B 41/38; H05B 41/39

[52] U.S. Cl. ..... 315/324; 315/169.4; 315/363; 340/766; 340/772

[58] Field of Search ..... 315/324, 169.4, 363; 340/766, 772, 780

[56] References Cited

U.S. PATENT DOCUMENTS

| | | | |
|---|---|---|---|
| 2,015,885 | 10/1935 | Dällenbach | 315/169.4 X |
| 4,071,809 | 1/1978 | Weiss et al. | 315/324 X |
| 4,208,618 | 6/1980 | Heine | 315/324 |
| 4,283,659 | 8/1981 | Beckerman et al. | 340/780 X |
| 4,326,150 | 4/1982 | Kobayashi | 315/325 |
| 4,347,460 | 8/1982 | Latassa et al. | 315/57 X |
| 4,368,485 | 1/1983 | Midland | 340/766 X |
| 4,486,749 | 12/1984 | Kishino et al. | 340/772 |

FOREIGN PATENT DOCUMENTS

| | | | |
|---|---|---|---|
| 2031610 | 4/1972 | Fed. Rep. of Germany . | |
| 54-160070 | 12/1979 | Japan | 315/324 |
| 354908 | 8/1931 | United Kingdom . | |
| 2053547 | 2/1981 | United Kingdom . | |

*Primary Examiner*—David K. Moore
*Assistant Examiner*—Vincent DeLuca
*Attorney, Agent, or Firm*—Griffin, Branigan & Butler

[57] ABSTRACT

This light emitting element (24) constitutes a pixel a plurality of which when arranged in rows and columns may form a matrix display board.

The element comprises one or more discharge tubes (10, 11, 12). For a board displaying images (textual or video) in color the internal wall of each tube is coated with a fluorescent substance which responds respectively to the red, green and blue portions of the spectrum. By independently varying the intensity of the light emitted by each tube light is obtained at the element output the resultant wavelength of which may extend over the entire visible spectrum.

The invention finds use in a display board employed to convey information to crowds of people as for example in a sports stadium.

6 Claims, 8 Drawing Figures

COLOR MATRIX DISPLAY WITH DISCHARGE TUBE LIGHT EMITTING ELEMENTS

BACKGROUND OF THE INVENTION

This invention concerns a light emitting element intended for use in a matrix display board.

Up to the present time two types of elements have been proposed and employed for use in display boards: incandescent lamps and cathode ray tubes.

The main difficulties of incandescent lamps reside in their high power consumption (between 20 and 40 watts per element) and their relatively low yield (about 10 lumens per watt). It will also be noted that such lamps are relatively short-lived (average 1000 hours) and have a colour temperature which is variable as a function of the energizing voltage at the terminals thereof as well as a progressive diminution of the luminescent intensity because of the interior blackening of the bulb as a function of the length of service. Such elements have likewise been proposed to equip display boards in colour. In such cases for each pixel three lamps are required associated with coloured filters, or more simply, three lamps each having a coloured bulb. It will be however understood that for colour the difficulties mentioned above in respect of black and white displays are entirely present. On the positive side however it may be said that incandescent lamps are inexpensive elements easily changed and readily to be found on the market.

Thus, in a practical example, a black and white screen of 4.3 m high and 8.6 m wide comprises 160 lines and 80 columns, thus requiring 12,800 incandescent lamps. If the rating of each lamp is 25 W, the power necessary to energize all of them simultaneously to full luminosity will be on the order of 320 kW. It will be readily understood that such as screen requires a high capacity power source as well as a very considerable energy expense.

Cathode ray tubes have been used in colour screens as may be seen in the British patent publication No. 2 053 547 and U.S. Pat. No. 4,326,150. Although these concern a tube of which the manufacture is simplified relative to those known in television tubes, it is nonetheless quite complex and above all necessary to employ very high acceleration voltages therewith, this complicating considerably the realization of the assembly. Such a tube has however the advantage of a low energy consumption compared to that of an incandescent lamp.

To overcome the difficulties mentioned above, the present invention proposes a light emitting element comprising at least one discharge tube containing mercury vapour at low pressure the internal wall of said tube being coated with a fluorescent substance.

Such an element is known of itself but seems not to have been previously proposed for use in a matrix display board. In most cases it is applied in domestic lighting or for luminous signs.

In the first case, variable length tubes which may be straight or curved, have at each end electrodes which may be constituted by a filament coated with an emitting layer of oxyde. The gaseous atmosphere within the tube is comprised of argon for start-up at a pressure of several millimeters of mercury and of a drop of mercury. The discharge in the mercury vapour effects essentially ultra-violet radiation at a wavelength of 253.7 nm. The wall of the tube appears white from the nature of the fluorescent substance (phosphor) applied on the interior wall and intended to convert the ultra-violet radiation into visible light.

Certain luminous signs use a type of tube known as luminescent for which the discharge in the gas creates directly the luminous effect. In this case, the wall of the tube is either transparent or coloured without employing however the fluorescent phenomenon. The arrangement described in British specification No. 354 908 makes use of tubes filled with neon which gives an orange-red colour or mercury vapour which gives a blue colour. However the arrangement shown does not in any way constitute a matrix display since it comprises a multitude of rectilinear segments of various lengths and interlaced in such a manner as to form a letter or number by the illumination of a predetermined number of the segments. The light emitting element described in the German specification No. 2 031 610 also makes use of neon tubes to set up a display system for moving script. The cited element comprises three tubes emitting different colours. However no means are shown for mixing the colours so as to permit the obtaining at the element output light the resultant wavelength of which may vary throughout the visible spectrum. Generally luminescent tubes are poorly adapted to use in a matrix display since in order to obtain the three fundamental colours one is obliged to combine the filling gas with the colour of the tube, this leading to elements which will not emit the same light intensity for each of the three tubes.

With respect to the incandescent lamp, the fluorescent tube presents several advantages. It has a high yield of light on the order of 40 lumens per watt, this resulting for a comparable luminous flux in a considerably diminished energy consumption. The average life span exceeds 7,500 hours, this contributing to increase the reliability of the entire display. It likewise displays a very greatly diminished heat output this having as effect to reduce convection currents and blackened trails of dust brought about by such convection. Finally the tube displays a colour temperature which is invariable as a function of the luminosity by as well as a very feeble blackening of the bulb, localised at the placing of the electrodes, as a function of its length of service.

Relative to the cathode ray tube, the fluorescent tube shows energy consumption approximately the same. On the other hand, its price is considerably lower and it does not require to be energized at a high voltage. Finally, the number of electrodes is reduced.

Thus, the use of a fluorescent tube in a giant display screen as foreseen in the present invention enables the offering of a new and advantageous product by virtue of its lower energy consumption, the quality of the images presented and its reasonable price.

DETAILED DESCRIPTION OF THE INVENTION

Figure 1:
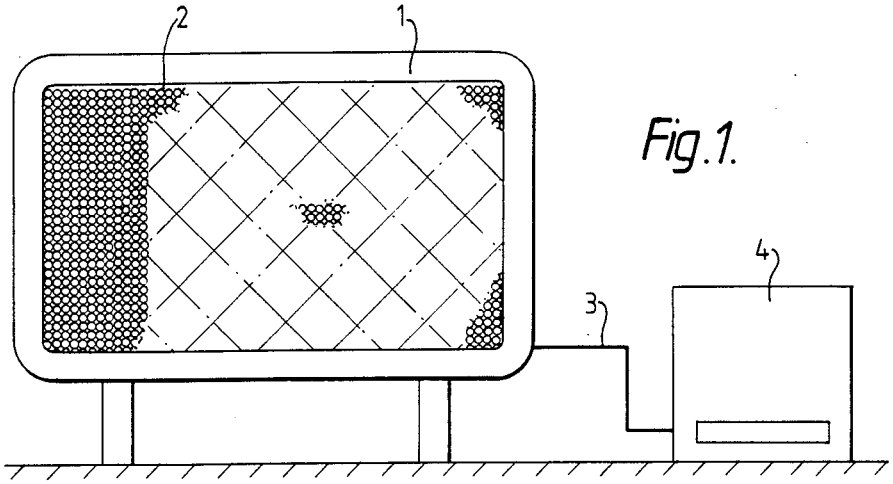
FIG. 1 is a schematic representation of a display board in accordance with the prior art.

FIG. 1 shows a matrix board as known from the prior art. The board 1 as shown is equipped with incandescent lamps 2 arranged in rows and in columns adjacent one another. Such an arrangement presently used in sports stadiums may be realized in large dimensions. Coupled to the display board by cable 3 one may find a control center 4. Such center is equipped with all the apparatus necessary for the transmission of static or moving images. It is thus possible to display texts such as sporting results, advertising matters, animated events or playbacks of such events by means of cameras, disks, magnetic tapes, etc. For each pixel there corresponds an incandescent bulb should the display be in black and white. An arrangement may then permit varying the luminous intensity produced by the bulb in order to arrive at multiple shades of light which may compose an image. In the case of displays in colour, each of the pixels may comprise three incandescent bulbs (red, green, blue) or three cathode ray tubes. By separately varying the luminous intensity produced by the three elements, one may arrive at a resulting light the wavelength of which may cover the entire visible spectrum.

Figure 2:
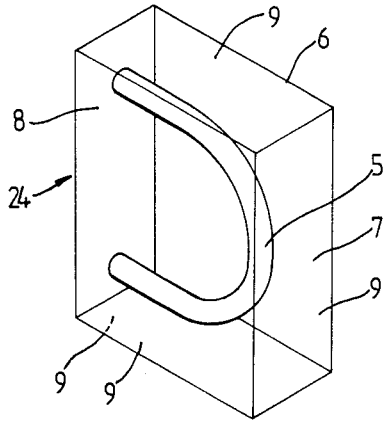
FIG. 2 shows an element adapted to emit white light and using a single fluorescent tube in accordance with a first variant of the invention.

As has already been set forth in the introduction, the present invention aims to replace the incandescent lamps or cathode ray tubes by at least one discharge tube generally known as a fluorescent tube in order to form the light emitting element or pixel. FIG. 2 shows such an element 24. The fluorescent tube 5 is mounted in a compartment 6. In order to respond to the physical laws which govern and in recalling that the power of the light emitted is a function of the length of the tube, tube 5 must have a certain length. In order to arrive thereat, it is preferable for the present purpose to give it a U form. Thus the visible face 7 of the element remains within dimensions which are compatible with the matrix display proposed, that is to say about 80 $cm^2$, this representing a square of about 9 cm on each side.

It will be understood however that in order to utilize the entire luminous radiation of the tube, thus as well that of the rectilinear portions, it will be necessary to provide a reflecting system returning the light coming from said rectilinear portions towards the front part of the element. This may be obtained for example by means of a reflector placed behind the compartment at wall 8, this reflector being completed according to the geometry of this compartment by a diffusing mirror forming the walls 9 of the compartment.

The compartment shown in FIG. 2 is a parallelepipedon. One may readily imagine other geometries without departing from the present invention. Thus the compartment could be triangular with the summit of the triangle where the tube electrically is connected, this with the purpose of improving the reflection effect presented by the walls. Moreover, the front face could be provided with an anti-reflection system.

The light emitting element which has just been described may be employed in black and white display boards. The element will be provided with a socket for electrical connexions and a simple system of attachment in order to render it easily detachable. Thus conceived it will be readily interchangeable and very accessible to maintenance personnel.

Figure 3:
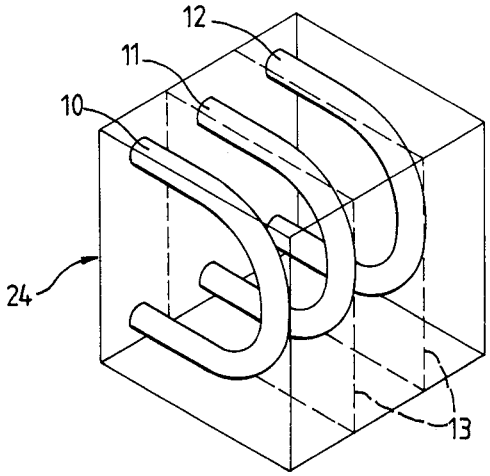
FIG. 3 shows a coloured light emitting element equipped with three fluorescent tubes in accordance with a second variant of the invention.

FIG. 3 shows a pixel 24 for coloured light provided with three fluorescent tubes. It is distinguished from what has been shown in FIG. 2 only by the juxtaposition of three fluorescent tubes of different colours 10, 11 and 12. As has already been said above, it is the fluorescent substance applied onto the wall of the tube which transforms the ultra-violet radiation of the discharge into visible light. Thus, in the pixel of FIG. 3 tube 10 radiates in the red (one might use for instance calcium borate as a fluorescent substance), tube 11 in the green (willemite) and tube 12 in the blue (calcium tungstate). With a mixture having suitable proportions of the several substances, one may produce white light and it is such a mixture which may be utilized for the tube shown in FIG. 2.

It may be mentioned that the three base colours may also be obtained by means of three white light emitting tubes each completed by a coloured filter independently located in front of the tube. If this arrangement presents the disadvantage of adding extra components and diminishing the light yield it has however the advantage of requiring only tubes of a single white colour and which will necessitate no particular preparation as to the fluorescent substance.

Should one independently vary the intensity of the light emitted by each of the three coloured tubes one obtains light at the output of the element the resultant wavelength of which may vary from violet to red, that is to say from 330 to 700 nm it being understood that the observer remains a certain distance from the front face of the element.

The same observations which have been made vis-à-vis the white-black element may be made for the coloured element (reflectors, forms of the compartment, anti-reflection system, detachable construction). For certain special arrangements care should be taken to separate the colour tubes by bulkheads 13.

Figure 4:
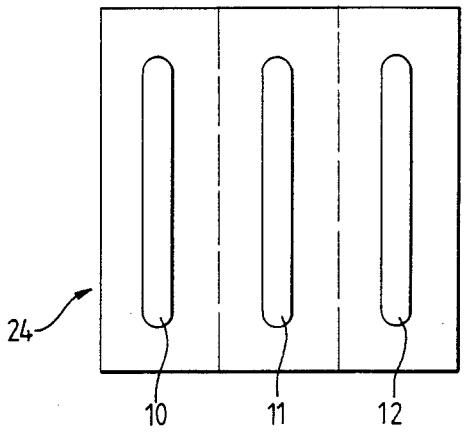
FIG. 4 shows the element of FIG. 3 seen from its face in accordance with a first arrangement of the tubes.
Figure 5:
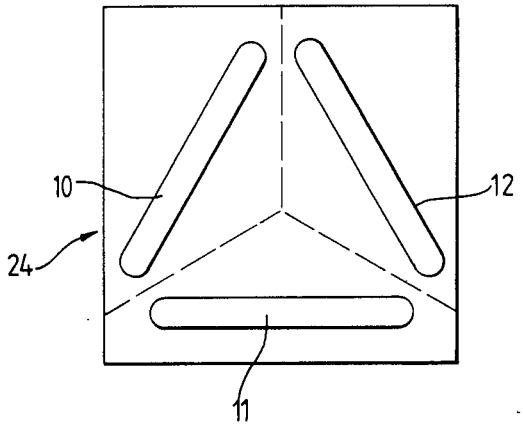
FIGS. 5 and 6 show light emitting elements according to other possible arrangements of the tubes than that shown in FIG. 4.
Figure 6:
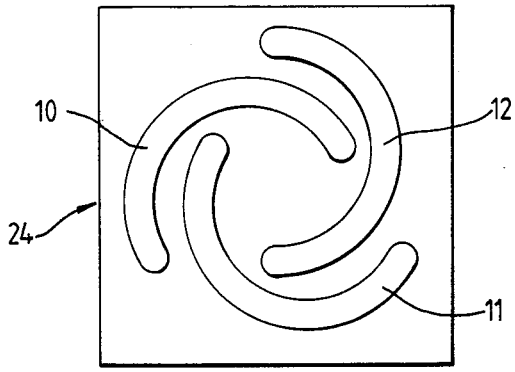

FIG. 4 is a face view of the element 24 of FIG. 3. From this view one may foresee various dispositions of the tubes in the light emitting element where, for instance, FIG. 5 shows a disposition where the tubes are arranged end to end in order to circumscribe a closed surface, here a triangle, and FIG. 6 shows an arrangement in spiral where the tubes seen from the front face present portions of circles. The ends of these portions are bent at 90° to form rectilinear portions which extend behind the plane of the figure.

Other dispositions than those shown in FIGS. 4, 5 and 6 may be envisaged without departing from the object of the invention. Thus the coloured element is not limited to utilization of three tubes. A fourth tube for instance could be added which in certain circumstances may improve the continuity of the luminous spectrum.

For the application herein proposed, one will utilize preferably hot cathode fluorescent tubes where at each end of the tube is to be found an electrode formed by a filament. The feed voltage is applied to each of the electrodes in order to provoke the discharge in and lighting up of the tube. When such a tube is used for domestic lighting at standard line frequency, it is generally necessary to provide a starter and a ballast inductance in order to limit the current. It is known that such an arrangement causes a certain delay in the lighting up which naturally is unacceptable for the present application where one wishes to display not only static texts but also moving images coming from living scenes (camera or television pick-up). Energization at high frequency permits not only an instantaneous lighting up of the tube but further a diminution of the energy consumed on the order of 20% since the luminous yield of the tube increases with the frequency. This arrangement permits also reduction of the ballast volume, and consequently the weight and the price. Such energization is briefly described in "Hexfet Databook, International Rectifier, 1981" at the paragraph "fluorescent lighting".

Figure 7:
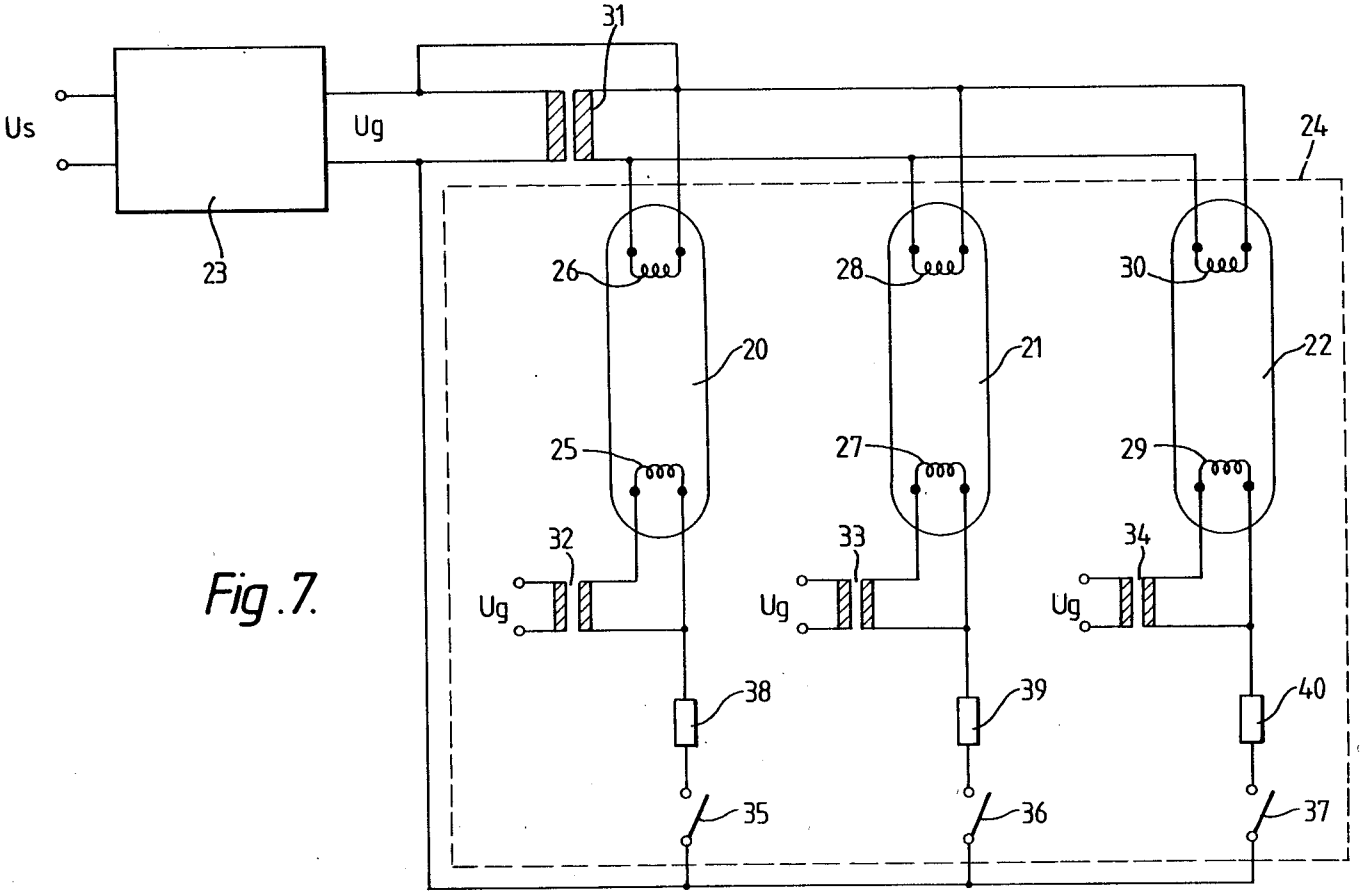
FIG. 7 is an electrical schematic showing the energization principle of a light emitting element employing three coloured fluorescent tubes.

FIG. 7 shows a possible schematic for energizing an element 24 according to the invention. Here the element comprises three fluorescent tubes 20 (red), 21 (blue) and 22 (green). A power generator 23, dimensioned to feed a plurality of elements, provides a voltage Ug the frequency of which is chosen to be between 5 to 30 kHz from the line voltage Us. Filaments 25 to 30 are fed by means of the common transformer 31 connected to filaments 26, 28 and 30 and transformers 32, 33 and 34 to feed respectively filaments 25, 27 and 29. The primary winding of each of these transformers is connected to the energy source Ug.

It is to be noted that transformer 31 may likewise be dimensioned to feed a plurality of pixels and not only the three tubes forming a single light emitting element. To insulate galvanically filaments 25, 27 and 29 from the corresponding filaments 26, 28 and 30, it is necessary to provide three separated transformers 32, 33 and 34 or a single transformer having several secondary windings. It will be noted that these transformers are of reduced dimensions since they function at a high frequency.

The tubes 20, 21 and 22 are fired by acting respectively on the elements 35, 36 and 37 placed in series in the circuit of the tube and which are shown on the figure in the form of switches. The circuit of each of these tubes is respectively completed by an element 38, 39 and 40 which has for its purpose to stabilise the current flowing in the tube. This element may be a resistance, an inductance or a capacitor. The first case is of little interest since the resistance may bring about additional losses. In the two other cases, the elements may be of small dimensions in view of the high frequency.

According to the invention, the light intensity furnished by each of the tubes will depend in this system on the time during which the respective switch remains closed relative to a predetermined reference period. Thus, if judicious choice is made of the elementary colours for each tube and if the luminous flux emitted by each one is regulated by the duration of the closing of its respective switch, there will be obtained a colour which will be the result of a mixture of each of the luminous fluxes and which may extend over the entire visible spectrum.

Switches 35, 36 and 37 may take various forms, for example in the form of triacs controlled by video signals generated by a video camera via an analog-digital converter with appropriate control logic. Here will be found means known from the state of the art and which are applied to colour matrix display boards already found on the market.

Figure 8:
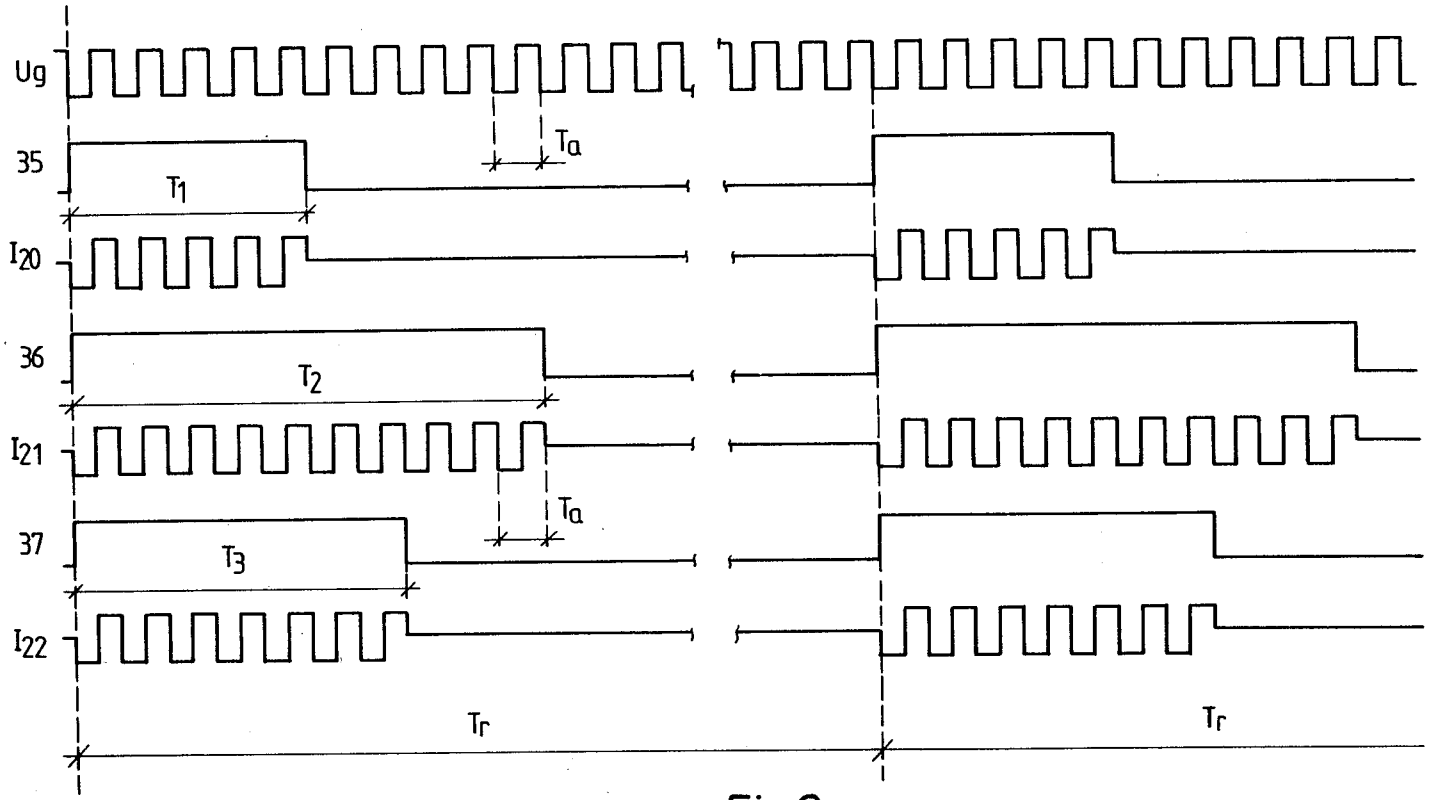
FIG. 8 is a timing diagram showing the feed voltage and the respective currents circulating in each of the light emitting elements.

FIG. 8 is a timing diagram showing the feed voltage Ug applied to the terminals of the tubes and the currents $I_{20}$, $I_{21}$ and $I_{22}$ circulating in each of them as a function of the closing respectively of the control elements 35, 36 and 37. In this diagram, the first line represents the feed voltage Ug furnished by generator 23 (see FIG. 7). The voltage is provided by the juxtaposition of reference periods $T_r$ comprising each at least 64 cycles $T_a$. The tube 20 (red) is energized at the luminous intensity desired by closing element 35 during a period $T_1 \leqq T_r$ from whence there results a current $I_{20}$ in the tube. In the same manner one proceeds for tubes 21 (blue) and 22 (green) during periods $T_2$ and $T_3$ respectively from whence there results currents $I_{21}$ and $I_{22}$. As has been explained above, the resulting colour at the output of the element will depend on the relative turn-on time of each of the tubes during the reference period. In other terms, one may say that the luminous intensity emitted by a single tube will be controlled by inhibiting a variable number of cycles $T_a$ during the period of reference $T_r$. This is likewise true for a tube radiating a white colour, whence this type of energization may also be applied to a black and white board.

Matrix boards of the black-white type already known employ 16 shades of grey between black and white, thus permitting a suitable reproduction of video images. In such case, a digitalized signal of 4 bits is sufficient. However, it will be noted that for a colour display, on the one hand, it is desired to have a variation of luminous intensity relative to a predetermined colour—as for black and white—and, on the other hand, it is desirable to separately vary the luminous intensity of each of the three tubes in order to create the determined colour. Consequently a control based on 4 bits signal is not sufficient. Practical experience has shown that it is necessary to provide at least 64 different shadings which requires that the reference period $T_r$ as mentioned above relative to FIG. 8 must comprise at least 64 cycles, this necessitating a digitalized signal of 6 bits. Still better results are obtained with 128 cycles (7 bits) or 256 cycles (8 bits), this permitting to adapt to the visual perception according to a logarithmic function for instance.

The energization of the light emitting element is not limited to the description hereinabove. In a variant which has not been shown on the drawing, instead of varying the number of cycles during the reference period one may vary the width of these cycles. One is thus led to a modulation by the pulse width (PWM).

What I claim is:

1. A matrix display board comprising a plurality of light emitting elements each comprising at least three discharge tubes containing mercury vapor at low pressure, the internal wall of each tube being coated with a fluorescent substance chosen to respond respectively to either the red, the green or the blue portion of the spectrum, and separate energizing means associated with each tube for independently controlling the variation of the light intensity emitted thereby so as to obtain light at the element output the resultant wavelength of which may extend over the entire visible spectrum, said separate energizing means comprising generator means for generating a high frequency current during a sequence of reference periods, each said reference period including a like plurality of cycles; and a plurality of gating means, each responsive to said high frequency current for selectively inhibiting the number of cycles of said current applied to a corresponding one of said tubes in a given reference period whereby the intensity of light emitted by one of said elements is varied by selectively varying the number of cycles of said current which are inhibited during a reference period from reaching the tubes comprising said one element.

2. A matrix display board as set forth in claim 1 wherein the tubes are of the hot cathode type.

3. A matrix display board as set forth in claim 1 wherein the tubes contained in each element are arranged side by side.

4. A matrix display board as set forth in claim 1 wherein the tubes contained in each element are arranged end to end so as to circumscribe a closed surface.

5. A matrix display board as set forth in claim 1 wherein the tubes contained in each element are curved and interlaced so as to form a spiral.

6. A matrix display board as set forth in claim 1 wherein a reference period emcompasses at least 64 of said cycles.

* * * * *